US005161450A

United States Patent [19]

Ishikawa

[11] Patent Number: 5,161,450

[45] Date of Patent: Nov. 10, 1992

[54] AIR MOTOR WITH WARM AIR INTRODUCTION MEANS TO PREVENT FREEZING

[75] Inventor: Yasuo Ishikawa, Chigasaki, Japan

[73] Assignee: Graco, Inc., Minneapolis, Minn.

[21] Appl. No.: 730,584

[22] Filed: Jul. 15, 1991

[30] Foreign Application Priority Data

Mar. 17, 1989 [JP] Japan ..... 1-65195

[51] Int. Cl.[5] ..... F01B 23/00; F16K 49/00

[52] U.S. Cl. ..... 91/55; 91/418; 137/339

[58] Field of Search ..... 60/407, 412, 689, 690, 60/685, 369, 370; 62/80, 402; 137/334, 338, 339, 301, 59; 91/418, 420, 466, 467, 55

[56] References Cited

U.S. PATENT DOCUMENTS

| | | | |
|---|---|---|---|
| 772,007 | 10/1904 | Theis | 137/339 |
| 2,270,365 | 1/1942 | Wilson | 137/339 |
| 2,594,762 | 4/1952 | Freund et al. | 137/339 |
| 2,749,925 | 6/1956 | Long | 137/339 X |
| 2,944,528 | 7/1960 | Phinney | 91/55 |
| 3,139,054 | 6/1964 | Van Heusen | 137/334 X |
| 3,180,350 | 4/1965 | Rill, Jr. et al. | 137/341 |
| 3,314,473 | 4/1967 | Smith et al. | 62/51.2 X |
| 3,747,338 | 7/1973 | Tapp | 91/418 X |
| 3,789,954 | 2/1974 | Raleigh | 181/33 |
| 4,154,147 | 5/1979 | Cagle | 91/55 |
| 4,406,596 | 9/1983 | Budde | 417/393 |
| 4,566,867 | 1/1986 | Bazan et al. | 417/393 |
| 4,580,406 | 4/1986 | Nims | 62/402 X |
| 4,708,601 | 11/1987 | Bazan et al. | 417/393 |
| 4,903,501 | 2/1990 | Harl | 137/341 X |
| 4,921,408 | 5/1990 | Kvinge et al. | 60/412 X |

*Primary Examiner*—Edward K. Look
*Assistant Examiner*—John Ryznic
*Attorney, Agent, or Firm*—Douglas B. Farrow, Esq.

[57] ABSTRACT

A device to prevent freezng of a reciprocating air motor which drives a reciprocating plunger pump for liquid pressurized transport in which a passage exclusively for exhaust which is connected to an exhaust passage and a exhaust pipe which is connected to this passage exclusively for exhaust are installed, as is a compressed air switch valve and an air tube which supplies hot air to the exhaust passage.

3 Claims, 7 Drawing Sheets

AIR MOTOR WITH WARM AIR INTRODUCTION MEANS TO PREVENT FREEZING

BACKGROUND OF THE INVENTION

This invention relates to a device which prevents the freezing of a reciprocating air motor which drives a reciprocating plunger pump for liquid pressurized transport.

Conventional reciprocating air motors function by using compressed air as the drive source and release compressed air into the atmosphere at each pump stroke. A liquid pump (which picks up liquid and moves it under compression to the target site) is usually connected to such air motors at the bottom. An air motor is used in order to drive the liquid pump and usually operates at 50 or fewer strokes per minute.

The air motor consists of three principal parts, an air cylinder, air piston and a compressed air switch valve. The air piston rises or falls within the cylinder through the action of compressed air, and the direction of the moving stroke is reversed through actuation of the switch valve at the end of the stroke. The compressed air within the air cylinder is released into the atmosphere at this time, but the exhaust passage and the compressed air switch valve are usually cooled to a temperature of less than −30 degrees C. because of the phenomenon of adiabatic expansion during exhaust. Since moisture is usually present in the air which is supplied and in the air within the air motor, that humidity is turned into ice flakes at each incident of cooling brought about by exhaust, and the ice flakes adhere to each section within the exhaust passage and the air motor, and build up. Foaming resin can be attached to the inside of the air motor cover in order to reduce the noise during exhaust.

However, when ice flakes of humidity in the atmosphere accompanying the aforementioned exhaust form in such conventional airdriven air motors, they readily deposit and accumulate on the exhaust passage and on the compressed air switch valve. This phenomenon occurs within a short period of time when there is a large amount of humidity in the air which is supplied or when the operating speed of the air motor is fast. As a result, the exhaust passage is constricted by the ice flakes which deposit, thereby reducing the amount of exhaust air, making operation of the air motor irregular. Moreover, the switching operations are restricted by the ice depositing on the compressed air switch valve and this can stop operation of the air motor. The exhaust passage can be blocked by ice deposits, leading to the inability to operate the air motor. The countermeasure has been to adequately heat the supplied air to avoid the forming of ice, but a vast amount of thermal energy is required for adequate heating since the amount of air supplied to the air motor is usually great. This necessitates vast expenditures for heating equipment.

SUMMARY OF THE INVENTION

This invention was devised focusing on the aforementioned problems. The exhaust passage is modified from the conventional type, in which cooled exhaust which is released from an air cylinder into the atmosphere is released after passing through the space between the air motor cover and outer wall of the cylinder, into a type in which exhaust is released directly into a exhaust pipe leading directly to the exterior without passing between the motor cover and cylinder outer wall. In addition, a compressed air stream at normal temperature or which has been heated is released into the compressed air switch valve of the air motor. This warms the compressed air switch valve mechanism as well as the exhaust passage to prevent their freezing. By so doing, a device which prevents the freezing of an air motor is provided, thereby solving the aforementioned problems.

In order to eliminate the aforementioned problems, the device which prevents freezing within a reciprocating air motor which drives a reciprocating plunger pump for liquid pressurized transport has a structure in which warm air is supplied to the compressed air switch valve and to the exhaust passage in order to prevent their rapid cooling by the action of adiabatic expansion of the exhaust which is released from the exhaust port of the compressed air switch valve, in order to prevent the freezing of the compressed air switch valve mechanism and the exhaust passage by the humidity in the air and in order to thereby prevent the action of the air motor from stopping. An exhaust tube which runs to the exhaust passage and a exhaust pipe connected to this exhaust tube are installed, and an air tube which supplies warm air to the compressed air switch valve and to the exhaust passage is installed.

This invention supplies warm air to the compressed air switch valve and to the exhaust passage through the air tube, thereby heating the interior of the air motor, heating the exhaust pipe and preventing the freezing of the air motor by ice flakes.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
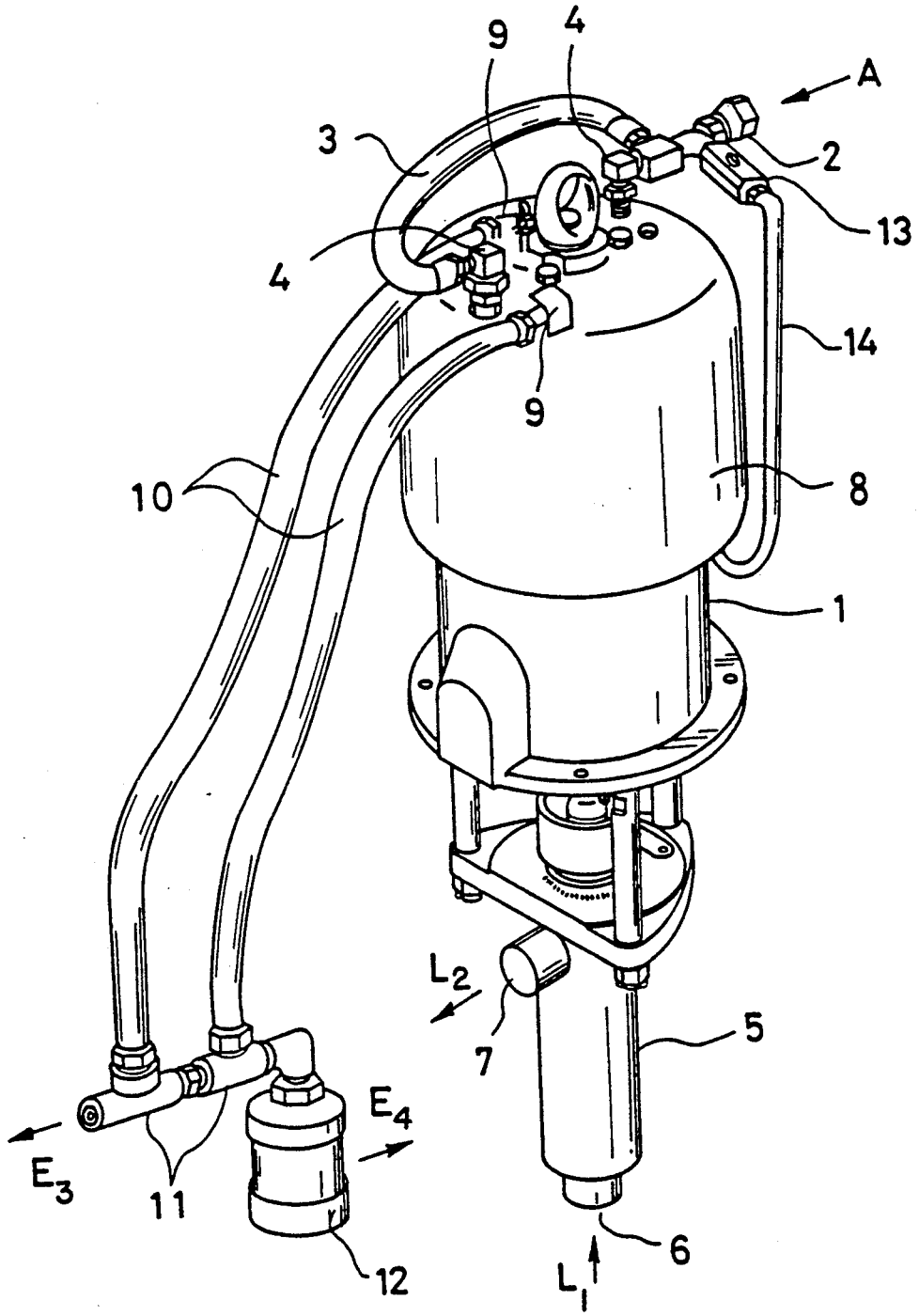
FIG. 1 is an external view of the reciprocating plunger pump for liquid pressurized transport of this invention.
Figure 2:
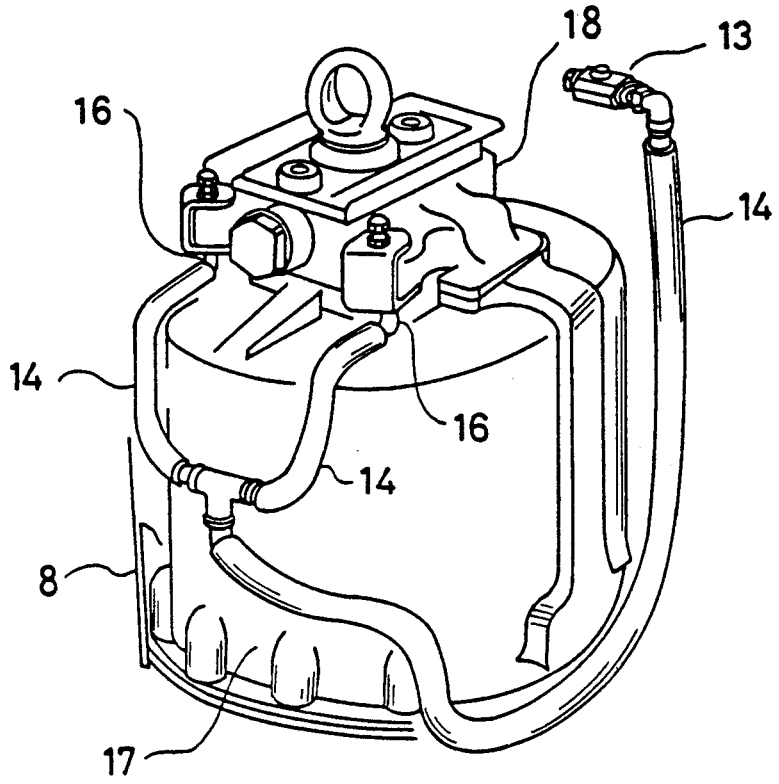
FIG. 2 is an external view of the air motor of this invention with the air motor cover removed.

First, the structure and the action are explained consulting FIGS. 1 to 4. The air motor 1 inducts compressed air A from outside through the coupling 2, and the driving air is conducted to the interior of the air motor through one or two couplings 4 after passing through the air hose 3, thereby driving the motor. A liquid pump 5 is connected to the air motor 1, and liquid L1 is drawn up from the liquid inlet 6. Liquid L2 is then discharged through the liquid outlet 7. An air motor cover 8 is installed on the air motor 1 to protect the internal mechanism of the air motor.

The exhaust E3 and E4 from the air motor 1 is released outside from the air motor 1 through the pipe exhaust 10 from two exhaust sections 9, and the exhaust either is released into the atmosphere after the noise has been reduced by the muffler 12 after being directed to the muffler by the coupling 11, or it is released into an exterior exhaust pipe (not illustrated) without passing through the muffler 12.

The air valve 13 is a valve for retrieving compressed air from the coupling 2 by separate route. Hot air HA is released through the exhaust outlet 20 of the valve plate 15 of the air motor 1 after passing through the air tube 14. The air tube 14 is inserted into the manifold 18 via two warm air inlets 16 (FIG. 2) after passing throughout the space between the air cylinder 17 and the air motor cover 8. A fixed amount of air at room temperature or hot air HA is usually released. The amount of heated air which is released is altered by adjusting the aperture of the air valve 13. In addition, when the air E1 which is released to the exhaust section 9 is to be heated, the air valve 13 is transferred to a separate air source and the air which is heated by the heater (not illustrated) is inducted therein. The heater may be small and inexpensive since it need only heat a slight amount of air at that time.

Figure 3:
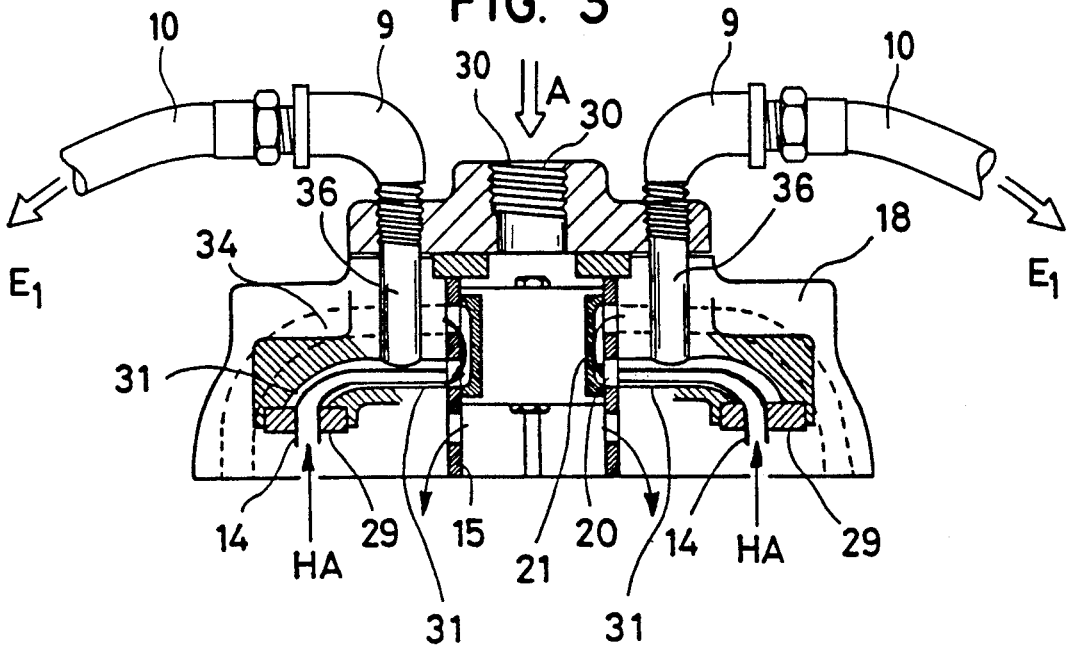
FIG. 3 is a profile of the slide valve section of this invention.
Figure 4:
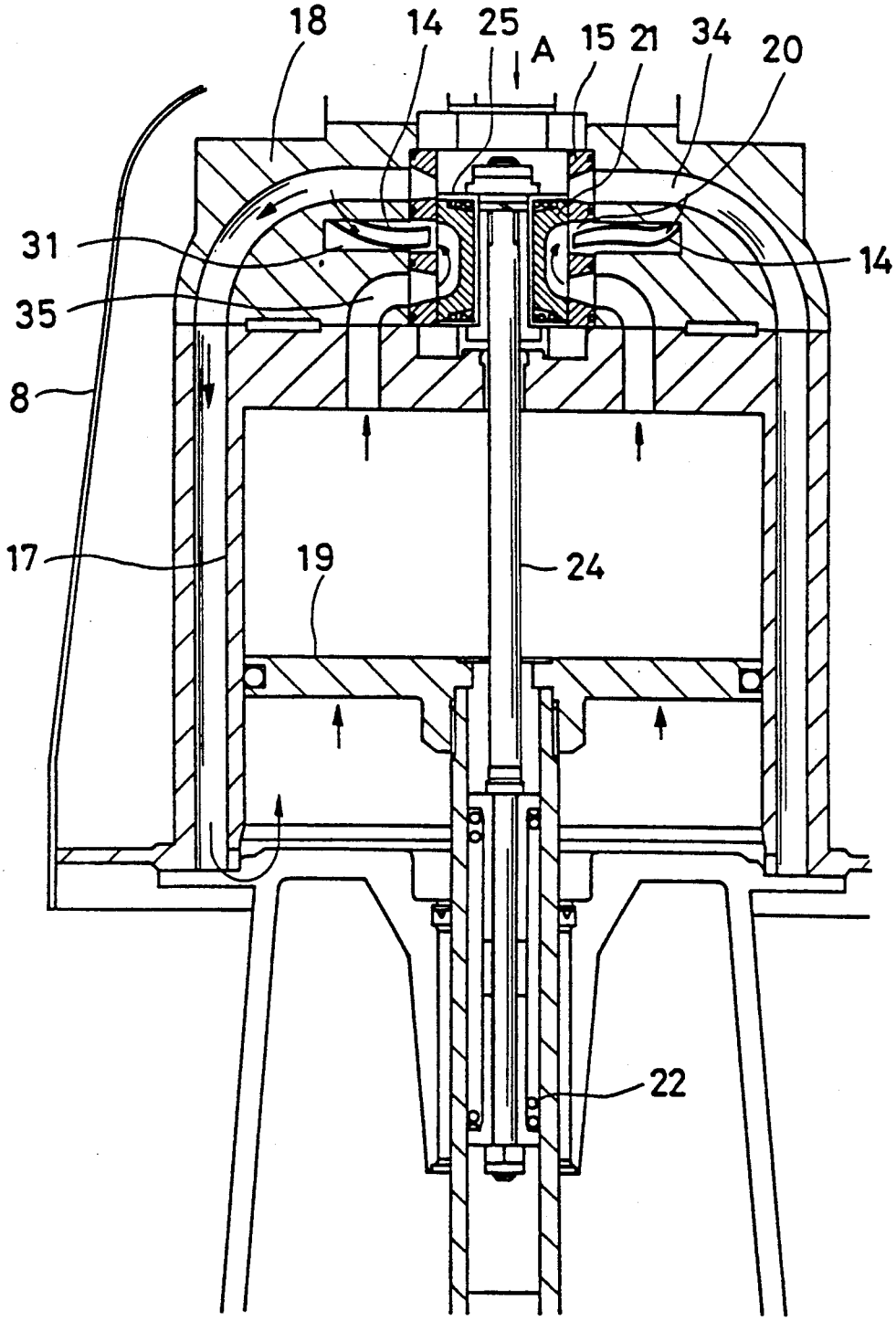
FIG. 4 is an explanatory profile of the air motor of this invention.

FIGS. 3 and 4 illustrate the supply of warm air to the passage exclusively for exhaust 36 and to the exhaust passage 31 in this invention.

The air tube 14 is inserted into the exhaust passage 31 of the manifold 18 to supply compressed hot air. The air tube 14 and the manifold 18 are sealed and fixed by a rubber gasket 29. On the other hand, passages exclusively for exhaust 36 are newly installed on the left and right of the exhaust passage 31 of the manifold 18 at positions where the air cylinder 17 does not induce cooling. The exhaust pipe (hose) 10 is connected via a coupling, and exhaust is thereby conducted outside.

Figure 5:
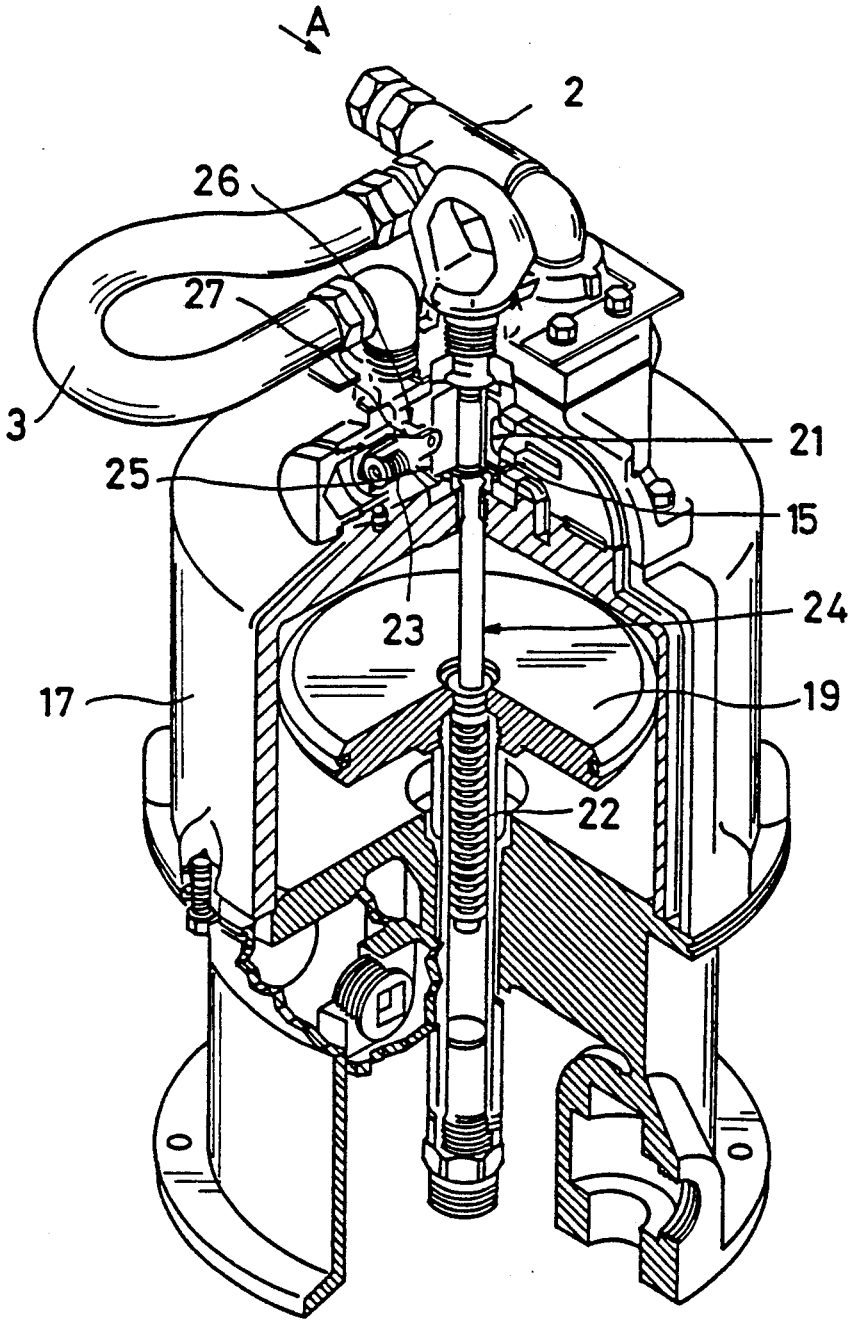
FIG. 5 is an oblique view illustrating a conventional air motor excluding the air tube, exhaust tube and the exhaust pipe of this invention.
Figure 6:
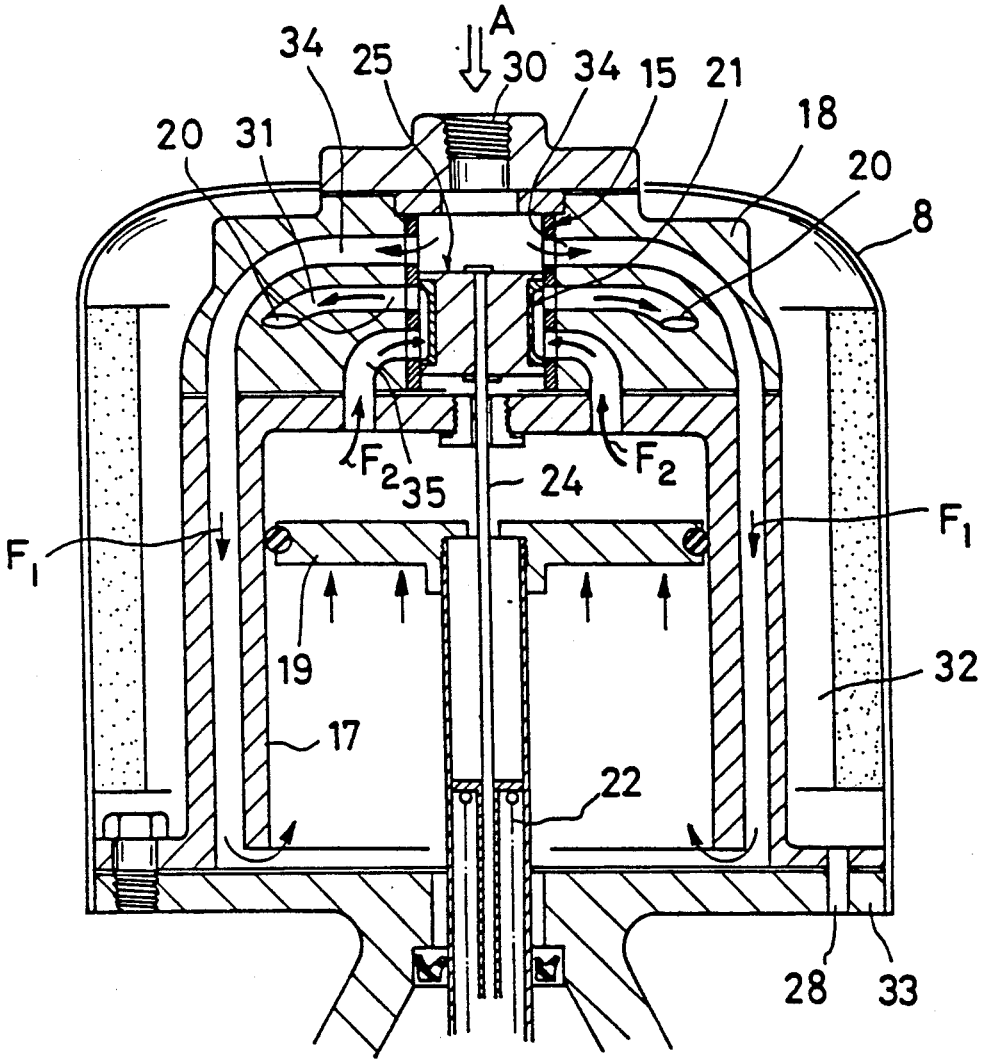
FIG. 6 PRIOR ART
FIGS. 6 and 7 are profiles of conventional air motors for explaining the actions of the supply air passages, exhaust air passages and the air piston.
Figure 7:
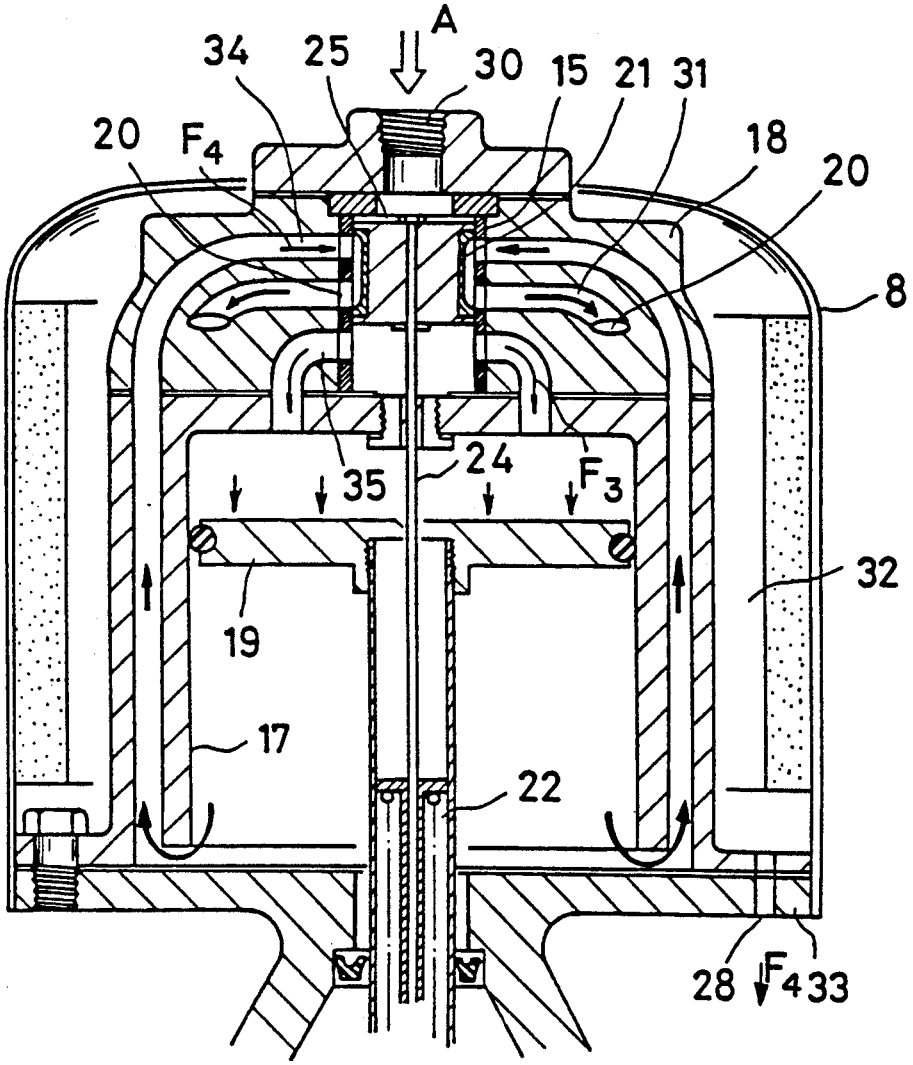
FIG. 7 PRIOR ART
Figure 8:
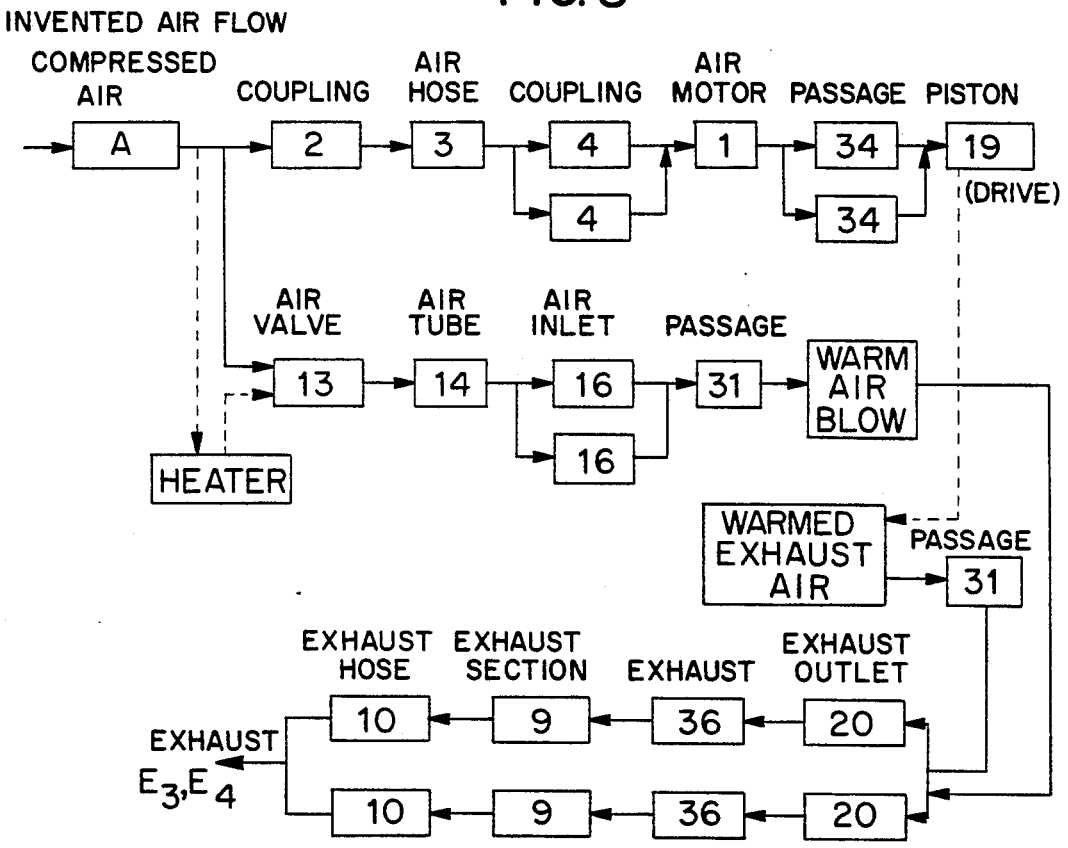
FIG. 8 shows the instant invention in schematic fashion.

Next, the structure and action of the compressed air switch valve (slide valve) 21, the air piston 19 and the air passage of the air motor 1 in a conventional example illustrated in FIGS. 5 to 7 are explained.

FIG. 5 is an oblique view illustrating a conventional air motor excluding the air tube, exhaust tube 36 and the exhaust pipe of this invention. FIGS. 6 and 7 are explanatory figures of the action of the passages for air supply and exhaust as well as the action of the air piston. The piston 19 rises and falls within the air cylinder 17 after being subjected to compressed air from the coupling 2. The slide valve 21 rises and falls due to the spring action of the springs 22 and 23, and the piston 19 engages in reciprocating movement through the supply of compressed air at the top of bottom of the piston 19 from the air passage which is formed by the slide valve 21 and the valve plate 15. The trip rod 24 engages the spring 22, and provides thrust for the snap action when the stroke of the piston 19 changes. The shuttle 25 is connected to the spring case 27, which acts using the pin 26 installed on the left and right at right angles to the slide valve 21 as the fulcrum, and the vertical movement of the shuttle 25 is promoted by the compression of the spring 23 which effects snap action due to switching from the left and right directions. At the end of the rising and falling strokes, the compressed air reaches the exhaust section 9 after passing through the exhaust passage 31 of the manifold 18.

FIG. 6 illustrates the upward stroke of the piston 19. The compressed air which is supplied from the compressed air supply inlet 30 passes through the upper supply-exhaust passage 34 of the valve plate 15 and enters the air cylinder 17 from below through passages on the left and right by the route illustrated by the arrows F1. At this time, the air at the top of the piston 19 is released to the exhaust outlet 20 through the lower supply-exhaust passage 35 by the route illustrated by the arrows F2. The exhaust passage 31 in the center of the manifold 18 is usually for exhaust. The upper and lower supply-exhaust passages 34 and 35 are either air supply passages or exhaust passages depending on whether the piston is rising or falling.

FIG. 7 illustrates the piston 19 reaching the top of its stroke, at which time the compressed air switch valve 21 switches automatically through in the figure, and the piston 19 then moves to the descending stroke. In the figure, the arrow F3 illustrates the air supply flow while the arrow F4 illustrates the exhaust flow.

FIG. 7 illustrates the passage through which exhaust flows outside from the manifold 18. The exhaust F4 is discharged from the manifold 18 and is released into the space 32 between the air motor cover 8 and the air cylinder 17. The conventional structure is illustrated in which the exhaust is released outside of the air motor via a small bore discharge port 28 formed in the flange section 33 below the air cylinder 17.

The exhaust temperature is −30 degrees C., and exhaust is carried out while the outside of the air cylinder 17 is cooled.

As explained above, the structure in this invention involves the insertion of an air tube into the stroke switch valve mechanism in the air motor and into the exhaust passage from outside. A slight amount of compressed air which has been heated or is at room temperature is released into this air tube, and the exhaust tube 36 is located so as not to cool the air cylinder. As a result, if the temperature within the air motor is usually at 20 degrees C., the rapid cooling by cooling exhaust air more than 50 degrees C. cooler, specifically, exhaust air at −30 degrees C., would be prevented, the freezing of the humidity in the ambient air or in the compressed air within the air supply would be prevented, thereby preventing the freezing of parts within the air motor and the arrest of their function, and ice flakes would not accumulate and block the passages within the exhaust passage. Thus, the air motor would be able to continue normal operations.

The foaming material installed in the air motor cover and the small bore exhaust hole formed into the flange in the conventional method reduce the exhaust noise during air motor exhaust, but freezing of various sections within the air motor readily develops due to the back pressure during exhaust. However, the freezing of an air motor and the arrest of its operations can be prevented while maintaining adequate noise baffling by adopting the exhaust method of this invention and measures to prevent freezing.

It is contemplated that various changes and modifications may be made to the pump without departing from the spirit and scope of the invention as defined by the following claims.

What is claimed is:

1. A reciprocating air motor comprising:

a cylinder;

a piston in said cylinder;

an exhaust passage connected to said cylinder for exhausting air after work has been performed; and means for introducing a continuous flow of relatively warm compressed air into said exhaust passage, said compressed air introduction means comprises a tube at least partially located in said exhaust passage; and an air switch valve controlling the flow of air in a first direction through said exhaust passage wherein said compressed air introduction means directs compressed air at said air switch valve.

2. The reciprocating air motor of claim 1 wherein said tube of said air introdution means directs said compressed air into said exhaust passage in a direction opposite said first direction.

3. The reciprocating air motor of claim 1 wherein said relatively warm compressed air is heated and air introduction means directs said relatively warm compressed air into said exhaust passage.

* * * * *